United States Patent [19]

Rüsse

[11] 4,295,527

[45] Oct. 20, 1981

[54] PROCESS AND DEVICE FOR THE CENTERING OF CASINGS AS USED FOR UNDERGROUND DRILLING

[76] Inventor: Rolf A. Rüsse, Celle, Fed. Rep. of Germany

[21] Appl. No.: 28,007

[22] Filed: Apr. 9, 1979

[30] Foreign Application Priority Data

Apr. 12, 1978 [DE] Fed. Rep. of Germany ..... 2815705

[51] Int. Cl.[3] ..... B25B 1/20; E21B 19/16

[52] U.S. Cl. ..... 166/315; 24/240; 166/77.5; 175/85; 269/43; 33/180 R

[58] Field of Search ..... 175/85; 166/77.5, 315; 285/24, 27, 39; 29/781, 240; 269/37, 43; 81/57.34, 57.35, 57.16; 33/180 R; 173/164

[56] References Cited

U.S. PATENT DOCUMENTS

| | | | |
|---|---|---|---|
| 1,187,665 | 6/1916 | Simms | 29/240 |
| 2,450,934 | 10/1948 | Calhoun | 166/77.5 |
| 2,540,451 | 2/1951 | Kelley | 33/180 R |
| 3,576,062 | 4/1971 | Matherne | 29/240 X |
| 3,633,771 | 1/1972 | Woolslayer et al. | 175/85 |
| 3,668,766 | 6/1972 | Carter et al. | 269/37 |
| 4,047,897 | 2/1978 | Behn | 269/43 |
| 4,051,587 | 10/1977 | Boyadijieff | 29/240 |

FOREIGN PATENT DOCUMENTS

| | | | |
|---|---|---|---|
| 204454 | 10/1923 | United Kingdom | 166/77.5 |

*Primary Examiner*—James A. Leppink
*Attorney, Agent, or Firm*—Max L. Wymore

[57] ABSTRACT

A casing clamp and guide arrangement to permit ease of centering and securing of the next section of pipe casing to a downhole string comprising an elongated stable member having clamp means at either end with one clamp adapted to engage the top of the uppermost downhole pipe casing and the other clamp adapted to clamp and stabilize the next pipe casing section into coaxial alignment for threadable connection therewith.

12 Claims, 4 Drawing Figures

PROCESS AND DEVICE FOR THE CENTERING OF CASINGS AS USED FOR UNDERGROUND DRILLING

BACKGROUND OF THE INVENTION

1. Field of Invention

With the advent of the world needing more and more energy and the need to explore deeper and deeper into the earth for oil, greater emphasis is placed upon the need for improved drilling techniques.

2. Description of Prior Art

Deep well holes are lined with steel casings. The casings are awkward to handle because of their great length and weight. The sections of casing are provided at each end with a thread, usually a conical fine-pitch thread. To line the bore hole with casing, the last section added to the string is lowered into the bore hole until only the upper threaded portion projects above the top of the bore. In order to be able to join two successive casings by means of the screw threads, the next casing is raised, as by means of a crane or the like, until the lower threaded end of the pipe section is above the upper threaded end of the last downhole section of casing, which has previously been suspended on the rig floor, and secured against rotation, by means of wedges. The raised section of casing is then lowered with its threaded lower end into the threaded sleeve at the upper end of the downhole casing. Next the raised section of casing has to be brought into accurate axial alignment with the downhole section of casing. This alignment is achieved manually usually from a temporary work platform suspended near the top end of the raised section of casing. Once alignment has been achieved, the raised section of casing is rotated to form a threaded connection with the downhole section of casing. Accurate axial alignment has to be maintained while rotating the upper section of casing, or damage to the threads will result. To align, and even more to maintain alignment while rotating, requires considerable strength and visual judgment by personnel on the operation. The method can be time consuming. Difficulties in aligning the sections, and maintaining such alignment, are considerably aggrevated in an off-shore environment, where frequently high winds and wave induced movements of the drilling rig strongly counteract efforts to align the casing sections. Thus, the reliability of a casing joint and the speed of the operation depends upon the muscular strength and the skill of estimating by sight of the operators.

SUMMARY OF INVENTION

The instant invention is directed to an improved method and apparatus for carrying out such method of connecting downhole well casings particularly in off-shore regions that is essentially independent of the muscular strength and skill of the operators in estimating the position of each casing added to the string. The improved method and apparatus avoids or substantially reduces damage to the threads and materially reduces the time required to complete a superior threaded connection. In off-shore regions, the presence of high winds and wave induced movement of the drilling rig makes the present invention particularly advantageous. The present invention provides a powerful and uncomplicated tool for the alignment and screwing together of casing under these adverse conditions not heretofore available in the prior art.

DESCRIPTION OF THE PREFERRED EMBODIMENT

Figure 1:
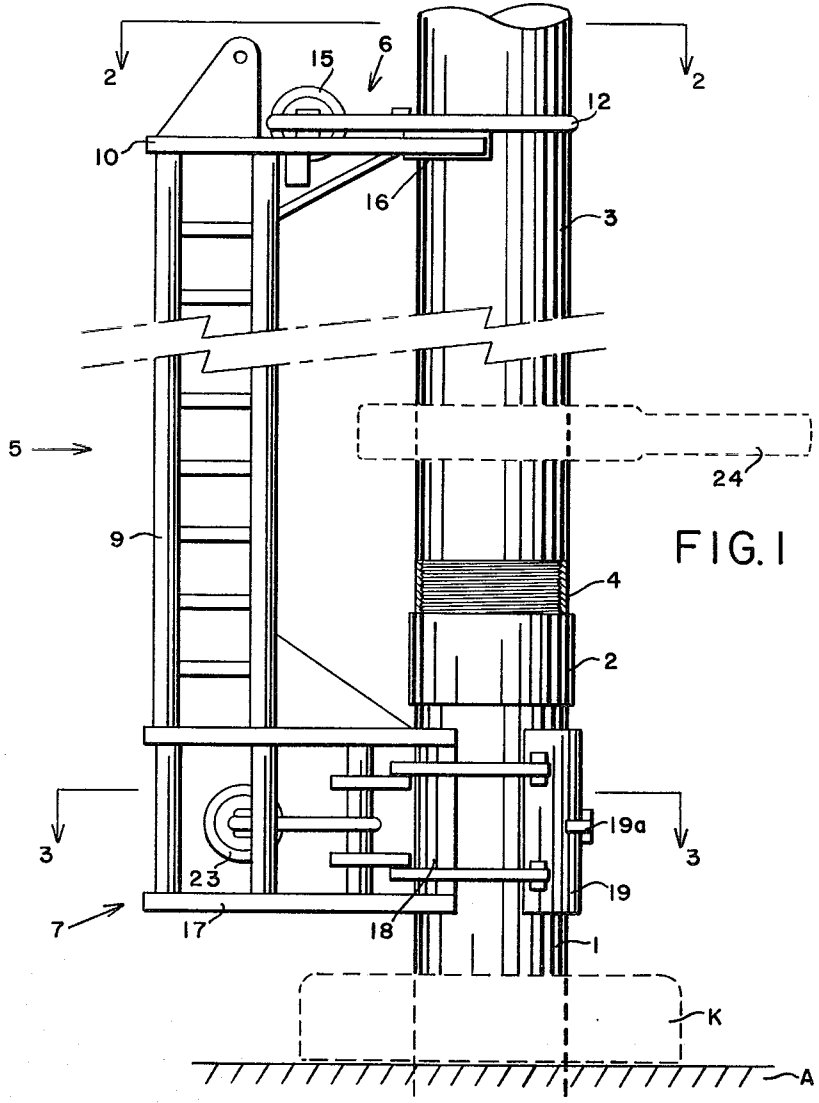
FIG. 1 is a side elevation of the apparatus of the present invention with portions broken away to conserve space showing the joining of two successive casings therewith.

Referring now to the figures and in particular to FIG. 1, the figure shows the apparatus 5 of the invention attached to a first casing 1 shown lowered into bore hole and wedged therein by wedges K such that only the upper end 2, to which threaded sleeve 2 projects above the rig floor A. Support wedges K ensure that the downhole section of casing 1 cannot be turned or lowered further. The lower clamp assembly 7 of device 5 is clamped onto the upper portion of casing 1 to restrict vertical or rotational movement, in the manner to be explained, such that the stabilized upright member 9 attached to clamp 7 assumes a position parallel to and extends above the casing 1 upwardly to a point proximate the upper portion of casing 3, as will now be explained. Above lowered casing 1 is shown a second casing 3, with a portion broken away, carried by a crane (not shown) or other suitable means.

At the upper end of upright member 9 there is positioned a mouth-shaped closable upper grip assembly 6 that opens to receive casing 3 in a snug but turnable fashion. The casing 3 is moved into position to be axially aligned with casing 1 and received by upper grip 6 which axially aligns the casings such that when casing 3 is lowered, the bottom end carrying threads 4 are lowered into and mates exactly with the threaded sleeve 2. Thus, by rotating the casing 3, the casings are threadably connected. The lower clamp assembly 7 and upright member 9 are designed to withstand the forces exerted by the insertion therein of casing 3 and to securely hold the casings in axially aligned relation. The upper grip assembly 6 can be opened and closed by remote control as by means of piston and cylinder 11. The dimensions of holder 6 are chosen such that casing 3 can be inserted into the holder, be turned therein and yet be held in axial alignment with the casing 1 to which it is to be attached. The upright stable member 9 is selected to be of a length to provide stability in holding casing 3 and a length sufficient to position upper grip assembly 6 in the upper half or at about two-thirds the length of the pipe section.

The upper grip assembly 6 is provided with a fixed carrier plate 10 which has one or more abutments 16 to engage and position the upper end of casing 3. One or more pneumatic or hydraulic pistons 11 may be mounted on plate 10 and operatively connected to claws 12. In addition, catches 14 for the claws 12 may be provided on the carrier plate to lock the claws in position without exerting pressure on the casing 3.

Figure 2:
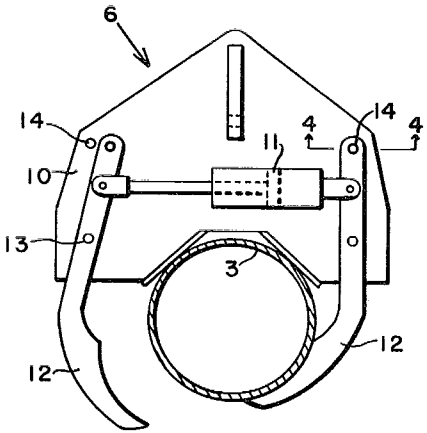
FIG. 2 is a top plan view along line 2—2 of FIG. 1.
Figure 4:
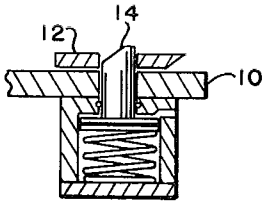
FIG. 4 is a view along line 4—4 of FIG. 2.

FIG. 2 provides a top plan view of the upper grip assembly 6 with one claw 12 in open position. The claws 12 are pivotally connected to the carrier plate 10 as at pivot 13 and catches 14 prevent claws 12 from opening accidentally after casing 3 has been gripped therein. Catches 14 may be formed by slidably mounted projections, as shown, or by remote controlled pawls, see FIG. 4. A cylinder 15 having a pneumatic or hydraulic piston 11 is positioned to act between the claws 12 either directly or through a transmission, not shown. Claws 12 are shaped on the inside to match the curvature of the casing so as to provide a good grip thereon without exerting pressure. The abutments 16 on carrier plate 10 contact the casing 3 at two points on the circumference thereof and serve to guide the casing during its movement and axial alignment. The claws 12 may be replaced with different sized jaws to provide for handling different sized casing.

Figure 3:
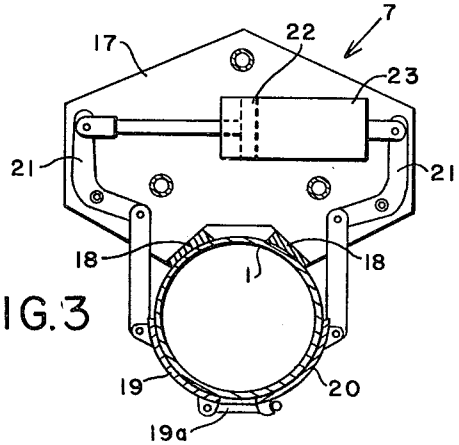
FIG. 3 is a view along line 3—3 of FIG. 1.

Referring to FIG. 3, the lower clamp assembly 7 is shown clamping pipe 1 against rotation and translation. Abutments 18 are provided on carrier plate 17 and are curved to match the curvature of the pipe to permit very tight clamping of the pipe without danger of damaging same. The clamping jaw 19 enclose pipe 1 by means of a clamping band 20 and latch 19*a*. The clamping band 20 is tightened by means of one or more pistons 22 in one or more cylinders 23 through crank arms 21, after the jaws have been placed around the pipe 1. Clamps 19, 20 and abutment 18 can be replaced by similar members to fit different sizes of casing.

The attach new sections of pipe to the downhole sections according to the present invention and with the apparatus of this invention, pipes 1 and 3 are to be screwed together. The downhole pipe 1 is secured against rotation and longitudinal movement by means of support wedges K, shown dotted, and the like. The device 5 is fastened to pipe 1 by means of a lower clamp holder 7 and made fast thereto by actuation of pneumatic cylinder 23 via a remote control, not shown, and latch 19*a*. The pipe 3 is then lowered with its threads 4 in mating relation with the threads in sleeve 2. The upper grip assembly 6 of the device 5 is positioned to grip pipe 3 and then the pneumatic cylinder 15 is actuated by remote control and the claws 12 are closed around the pipe 3. Then the centered pipe 3 is screwed into the sleeve 2 on pipe 1 by means of a tool 24, shown dotted, in the hands of an operator. After this operation is completed, the pneumatic cylinders are deactivated, also by remote control, and the assemblies 6 and 7 are opened. The wedges K are then loosened and pipe 1 is lowered with pipe 3 threadedly attached until its upper end is just above the working platform. The wedges K are again set to secure pipe 3 against the rotation or longitudinal movement and the process repeated to attach another section of pipe casing.

At the operator's option, the process may be reversed in such manner that the upper grip assembly 6 is locked around pipe 3 first, then the lower clamping assembly 7 is loosely secured around pipe 1 by locking latch 19*a*. Activating cylinder 23 and piston 22 will tighten the clamping assembly and bring pipes 1 and 3 into axial alignment.

A further modification is to eliminate latch 19*a*, replace linking mechanism 21 with pivot arms, similar to arms 12 in the upper holding assembly 6, to which clamps 19 and 20 are attached, and the force of the cylinder and piston 22 and 23 to open and close the clamp tightly for alignment.

While there have been described what at present are considered to be the preferred embodiments of this invention, it will be obvious to those skilled in the art that various changes and modifications may be made therein without departing from the invention. It is aimed, therefore, in the appended claims to cover all such changes and modifications which fall within the true spirit and scope of the invention.

What is claimed is:

1. A method for centering casings for deep well drillings, particularly in the off-shore region, which comprises the steps of:

lowering the uppermost casing section of a casing string into the bore hole of a well until only the upper threaded end thereof is above a work platform;

securing the casing in the bore hole against rotational and longitudinal movement;

raising a next section of casing having a threaded section on each end to a vertical position and positioned over the upper end of the casing in the bore hole;

lowering the lower threaded end of the raised casing section into the upper threaded end of the uppermost casing in the bore hole by means of a crane and the like;

attaching a clamping means to the upper portion of the uppermost casing section in the bore hole, said clamping means having an upwardly-extending portion extending substantially parallel to the casing for a distance equal to a substantial portion of the length of a casing;

providing a second clamping means operably independent of said first clamping means fixedly supported on the upper extremity of the upwardly-extending portion, which clamping means is adapted to clamp and hold the raised section of casing in coaxial alignment with the casing in the bore hole;

rotatably securing the raised section of casing to the second clamping means, supported on the vertical extending portion, to engage, position and maintain the raised casing, at a point removed from said first clamp a substantial portion of the length of a casing, in coaxial alignment with the casing in the bore hole; and, screwing the threads on the lower end of the raised casing section to the mating threads in the threaded end of the uppermost casing section to firmly secure the raised casing to the downhole casing by rotating the raised pipe casing.

2. Apparatus for centering and axial alignment of a superposed section of casing with an underlying casing section while being supported in a vertical position to permit the superposed section to be threadedly secured to the underlying casing section comprising:

first independently operated clamping means adapted to be securely clamped to the upper part of the underlying casing section;

extension means rigidly connected to said clamping means to extend upwardly alongside the casing for a substantial portion of the length of a superposed casing section;

said extension means being connected to said clamping means so as to extend in substantially parallel relation when the clamping means is fastened to the underlying casing section;

second independently operated clamping means mounted on the upper extremity of the extension means positioned and adapted to receive and support a superposed section of casing in coaxial alignment with the underlying casing section whereby the threads of the superposed casing section are aligned in mating relation with threads on the underlying casing section to permit threaded attachment of the superposed casing section to the underlying casing section essentially independent of a rig by turning the superposed casing;

wherein the first clamping means comprises a carrier plate, a pair of crank arms pivotally attached thereto, a pair of clamp elements having jaws operatively connected to one end of each crank arm and a piston and cylinder means operatively connected to the other ends of the crank arms adapted on actuation of the piston and cylinder means to clamp the clamp elements about said underlying casing section.

3. The apparatus of claim 2 wherein the second clamping means comprises a carrier plate, a pair of grip elements pivotally attached thereto by a pivotal connection, a piston and cylinder means operatively connected to said grip elements intermediate the ends and to one side of the pivotal connection adapted upon actuation of the piston and cylinder means to clamp the grip elements about and retain the superposed casing section.

4. The apparatus of claim 3 wherein the grip elements are provided with catches to hold said grip elements in closed position without exerting pressure on the casing.

5. The apparatus of claim 3 wherein the second clamping elements include curved jaws complimentary to the curvature of the casing.

6. The apparatus of claim 3 wherein the first clamping means has jaws of a curvature complimentary to the curvature of the casing and are held in closed position on the casing by means of a latch means.

7. The apparatus of claim 3 wherein the first and second clamping means are adapted to be replaced with jaws adapted to fit different casing diameters.

8. The apparatus of claim 2 wherein the carrier plate is provided with a pair of abutments adapted to support and clamp the casing therebetween and the clamp jaws.

9. The apparatus of claim 3 wherein the carrier plate of the second clamping means is provided with a pair of abutment bearings adapted to loosely support and clamp the casing therebetween and the jaws.

10. Method for centering pipe casings according to claim 1 wherein the casing section to be attached to the downhole string is lowered into engagement with the threaded end of the upper end of the casing string, the casing string is clamped against movement, the upper end of the pipe section to be attached is clamped in coaxial alignment with the casing string and the casing section is rotated to threadedly secure same to the threaded sleeve and the downhole string of casing.

11. The apparatus of claim 2 wherein the forces applied by the piston and cylinder to the first clamping means are sufficient to hold the casing against rotary and translational movement.

12. The apparatus of claim 4 wherein the forces applied by the piston and cylinder to the grip elements are sufficient to hold the grip elements in closed position without the catches.

* * * * *